US007105731B1

(12) United States Patent
Riedl

(10) Patent No.: US 7,105,731 B1
(45) Date of Patent: Sep. 12, 2006

(54) LOW NOISE VIBRATING STRING TRANSDUCER

(76) Inventor: James L. Riedl, 10311 E. Second Water Tr., Gold Canyon, AZ (US) 85218

( * ) Notice: Subject to any disclaimer, the term of this patent is extended or adjusted under 35 U.S.C. 154(b) by 0 days.

(21) Appl. No.: 11/120,392

(22) Filed: May 2, 2005

(51) Int. Cl.
*G10C 3/10* (2006.01)

(52) U.S. Cl. ..... 84/200; 84/743; 84/727

(58) Field of Classification Search ..... 84/200, 84/723, 725, 726, 727, 731, 743
See application file for complete search history.

(56) References Cited

U.S. PATENT DOCUMENTS

| | | | | | |
|---|---|---|---|---|---|
| 1,915,858 | A * | 6/1933 | Miessner | ..... | 84/723 |
| 2,239,985 | A * | 4/1941 | Benioff | ..... | 84/726 |
| 2,293,372 | A * | 8/1942 | Vasilach | ..... | 84/725 |
| 4,184,399 | A * | 1/1980 | Zuniga | ..... | 84/727 |
| 5,142,961 | A * | 9/1992 | Paroutaud | ..... | 84/726 |
| 5,168,117 | A * | 12/1992 | Anderson | ..... | 84/726 |
| 5,315,060 | A * | 5/1994 | Paroutaud | ..... | 84/726 |
| 5,401,900 | A * | 3/1995 | Lace | ..... | 84/743 |
| 5,484,958 | A * | 1/1996 | Ogawa | ..... | 84/731 |
| 5,637,823 | A * | 6/1997 | Dodge | ..... | 84/743 |
| 5,723,805 | A * | 3/1998 | Lacombe | ..... | 84/727 |
| 5,744,744 | A * | 4/1998 | Wakuda | ..... | 84/650 |
| 6,723,911 | B1 * | 4/2004 | Muramatsu et al. | ..... | 84/723 |
| 6,888,057 | B1 * | 5/2005 | Juszkiewicz et al. | ..... | 84/645 |
| 2002/0056358 | A1 * | 5/2002 | Ludwig | ..... | 84/738 |

* cited by examiner

*Primary Examiner*—Marlon T. Fletcher
*Assistant Examiner*—Christina Russell
(74) *Attorney, Agent, or Firm*—Schmeiser, Olsen & Watts LLP

(57) ABSTRACT

An apparatus and method for amplifying low amplitude vibrations from stringed instruments, and in particular guitars while reducing Gaussian and 60 Hz hum noise from the signal. In particular, the invention incorporates the use of one or more bipolar magnets in conjunction with high precision differential amplifiers and a power source. The bipolar magnets may be arranged at varying locations on the guitar as long as they are within range to induce an electrical signal in the strings when they are played. The signal is then fed through the amplifier circuitry whereby noise is eliminated and then played through a standard speaker.

11 Claims, 5 Drawing Sheets

LOW NOISE VIBRATING STRING TRANSDUCER

FIELD OF THE INVENTION

The present invention relates generally to transducers. In particular, transducers for vibrating strings as those in guitars or other stringed instruments. The present invention enables high-quality amplification of low-amplitude vibrations that originate from metal stringed instruments through the use of one or more bipolar magnets in conjunction with high precision differential amplifiers and a power source.

BACKGROUND OF THE INVENTION

In stringed instruments, amplification of low amplitude string vibrations is usually accomplished by utilizing an arrangement of wire-wound magnets under the strings of the instrument. To produce sound, the wire-wound magnets sense the vibrations of the strings electronically and a signal cable routes an electronic signal to an amplifier and speaker. The sensing occurs in a magnetic pickup mounted under the strings on the guitar's body. A bar magnet is typically used. When a vibrating string cuts through the field of the bar magnet in the pickup, a signal is produced in the pickup's coil. This pickup consists of a bar magnet wrapped with as many as 7,000 turns of fine wire. In the case of an electric guitar, the vibrating steel strings produce a corresponding vibration in the magnet's magnetic field and therefore a vibrating current in the coil.

There are many different types of pickups. For example, some pickups extend a single magnet bar under all six strings. Others have a separate pole piece for each string. Some pickups use screws for pole pieces so that the height of each pole piece can be adjusted. The closer the pole piece is to the string, the stronger the signal.

The pickup's coil sends its signals through a very simple passive component circuit on most guitars. A potentiometer adjusts the tone along with a low-pass filter that eliminates higher frequencies. By adjusting the potentiometer, it is possible to control the frequencies that get cut out. An additional resistor (typically 500 kilo-ohms max) controls the amplitude of the signal that reaches the jack. From the jack, the signal runs via the signal cable to an amplifier, which drives a speaker.

The present invention is a device that uses an integrated system of electronics and at least one bipolar magnet that is packaged on a thin and compact plastic tray that can be slipped between a guitar's strings and the body of the guitar. The device requires no holes be cut into the guitar and includes a volume control, output jack and an off-on battery switch on the tray. The device typically works with batteries that provide direct current and the entire device can be unplugged and removed if the player wants to play the guitar acoustically. The bipolar magnets may be placed anywhere on the tray as long as they are located near, or preferably under the guitar strings. As the magnets may be moved to different locations near the strings, the change in location of the magnets causes the various tones to be available to the player. If the magnets are moved rapidly, tremolo effects can be heard. The magnets may be of virtually any shape, although it is preferred that the magnets remain small and compact in size.

The strings are coupled to digital electronic processing for amplifying the string current that is induced from the bipolar magnets while eliminating annoying audio noise, principally Gaussian and 60 Hz hum. By utilizing digital processing, one can selectively boost or cut frequencies and further reduce noise from the string signal that were not possible with analog filters as described above.

The amplifiers used in the preferred embodiment are high-precision differential amplifiers that have high common mode rejection of about 90 db or more and low output noise of about 10 nano volt root hertz or less. High CMR is achieved by use of laser trimming of internal resistors in the differential amplifier IC to perfect matching ratio, which provides very high CMR.

It is also desirable to utilize super high field strength neodymium magnets of at least grade ND40. By using the high field strength magnets, a high string current is induced and consequently, much of the common noise found with conventional guitar string pickups is rejected. The present invention can also be used with all shapes and sizes of neodymium magnets. Typically, these types of magnets are economical because the manufacturing process simply involves the use of molds filled with neodymium powder and compressed into that mold shape.

DISCUSSION OF THE PRIOR ART

Transducers that are able to detect low amplitude vibrations from stringed instruments are well known in the prior art. The primary limitation of many transducers that utilize electromagnets is that most amplifiers must overcome the elimination of noise from the signal.

Other inventions in the prior art have attempted to overcome this problem. For instance, in U.S. Pat. No. 5,723,805 for Lacombe, the patent discloses a transducer for sensing low amplitude vibrations of stringed instruments. However, Lacombe's invention makes no mention of filtering noise. Additionally, the disclosed invention requires among other things an extensive modification to the guitar including the creation of new holes, and the potential need to reset the neck and utilize an expensive brass nut. Lacombe also utilizes single-ended amplifiers that allow a substantial amount of noise that is highly undesirable. Furthermore, Lacombe does not disclose the shielding of the circuits or cables in order to reduce noise, nor does Lacombe mention the use of ground planes near his circuits.

In U.S. Pat. No. 5,484,958 issued to Ogawa, the patent discloses a device for amplifying piezo electric currents flowing in the strings of a stringed instrument. However, this device does not disclose the use of bipolar magnets to act as a transducer. The same can be said of U.S. Pat. No. 5,637,823 issued to Dodge which utilizes a series of transducers that are fixed to the guitar. Specifically, the pickups are fixed to a plastic plate, which requires a massive hole to be cut into the guitar for accepting the plate. This configuration requires that the invention will only work for solid body guitars.

The U.S. Patents issued to Benioff (U.S. Pat. No. 2,239,985), Miessner (U.S. Pat. No. 1,915,858) and Vasilach (U.S. Pat. No. 2,293,372) also have limitations including the bulkiness of the elements of the invention; they offer no improvement in sound and often add noise to the output, and will require massive and non-economical changes to the traditional manufacturing of stringed instruments and in particular, guitars.

SUMMARY OF THE INVENTION

Broadly, it is an object of the present invention to provide a device for amplifying low-amplitude vibrations in stringed instruments;

It is a further object of the present invention to provide an amplifier that can be used upon a variety of stringed instruments and in particular, guitars.

It is a further object of the present invention to provide a device that can be attached to a guitar that requires no additional change in manufacturing and tooling.

It is a further object of the present invention to provide an amplifier that enables a wide tonal range without the use of tone controls;

It is a further object of the present invention to provide an amplifier that provides a high common mode rejection thereby creating a substantial reduction in noise contained in the amplified sound signal.

It is a further object of the present invention to utilize high-strength bipolar magnets to induce a current in the strings of the stringed instrument.

It is a further object of the present invention to utilize a high-precision differential amplifier to amplify the signal from the strings of the stringed instrument.

It is a further object of the present invention to include a digital signal processor in the amplification process in order to selectively boost or cut certain frequencies from the electrical signal in the string of the stringed instrument, and further reduce noise by digitally over-sampling the signal.

The description of the invention which follows, together with the accompanying drawings should not be construed as limiting the invention to the example shown and described, because those skilled in the art to which this invention appertains will be able to devise other forms thereof within the ambit of the appended claims.

DESCRIPTION OF THE PREFERRED EMBODIMENT

Figure 1:
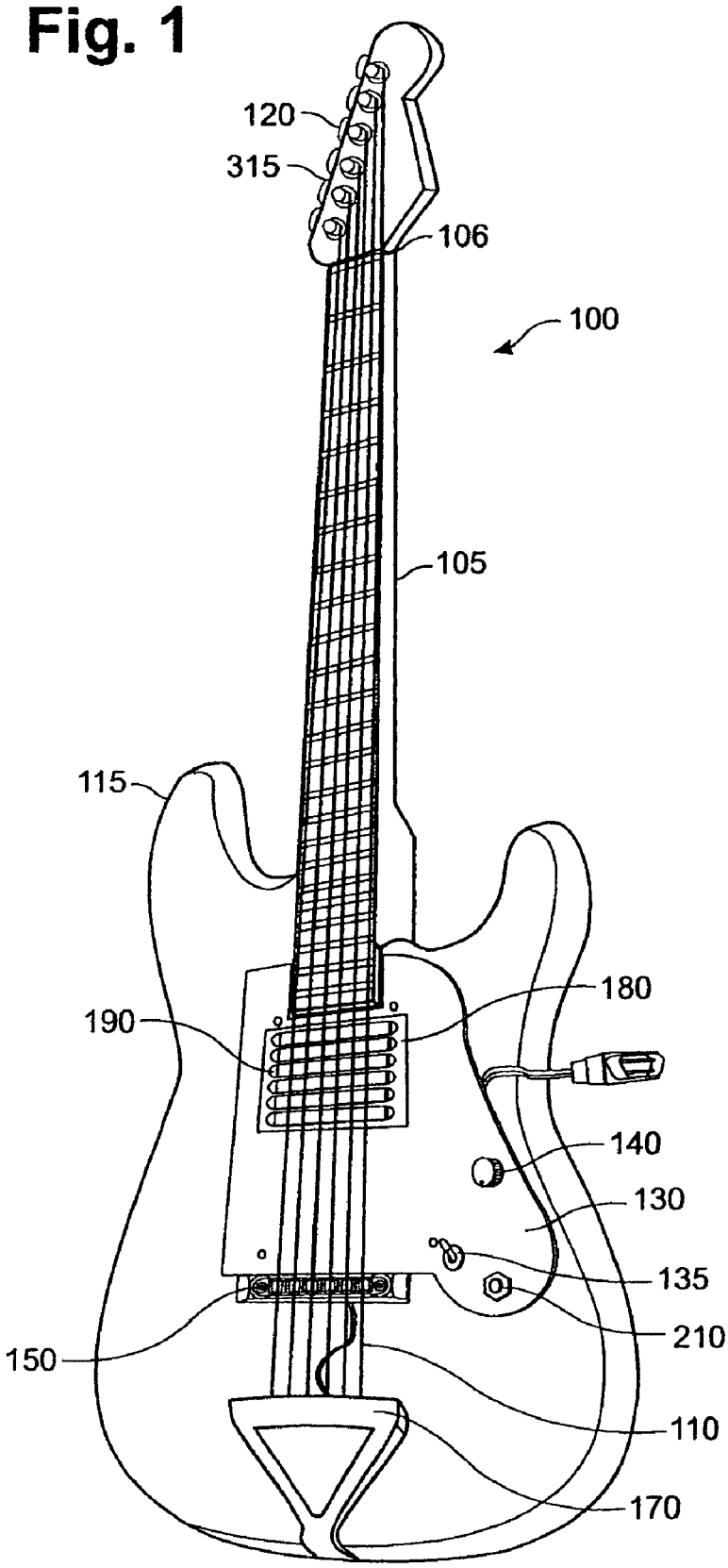
FIG. 1 is a front view of a standard guitar comprising the base plate with bipolar magnetic pickups under the strings.

By way of one example of many to serve as background in understanding the present invention, FIG. 1 shows a standard electric guitar 100. The guitar 100 has six strings 110 that are connected from one end at the tuning head 120 to an opposite end of a sting securing mechanism 170 across a fret board 105 and a guitar body 115. The strings 110 are typical guitar strings made of metal and are wound tight at the tuning knobs 315 so that the stings 110 will be in tune when the strings are picked. The strings 110 rest upon a bridge 150. The bridge 150 is located slightly above the securing mechanism 170.

Directly under the strings 110 and below the fret board 105 sits the base plate 130. The base plate 130 is typically made from thin, rigid, abrasion resistant plastic designed to fit underneath the stings of most guitars without modification. Attached to the base plate are the volume knob 140, the power switch 135, and an output jack 210. A plastic magnet tray 180 is also shown and positioned on the plate 130 directly below the strings 110 between the fret board 105 and the bridge 150. The plastic magnet tray 180 is used to hold at least one, but preferably a series of strong bipolar magnets 190. The bipolar magnets 190 must be positioned below the strings 110 in the preferred embodiment.

Figure 2:
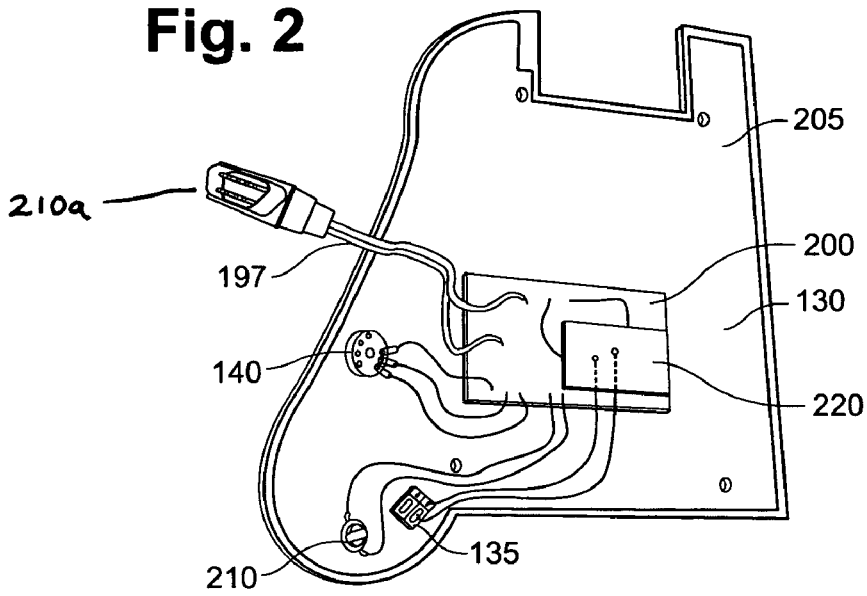
FIG. 2 is a rear view of the base plate showing a basic wiring configuration.
Figure 4A:
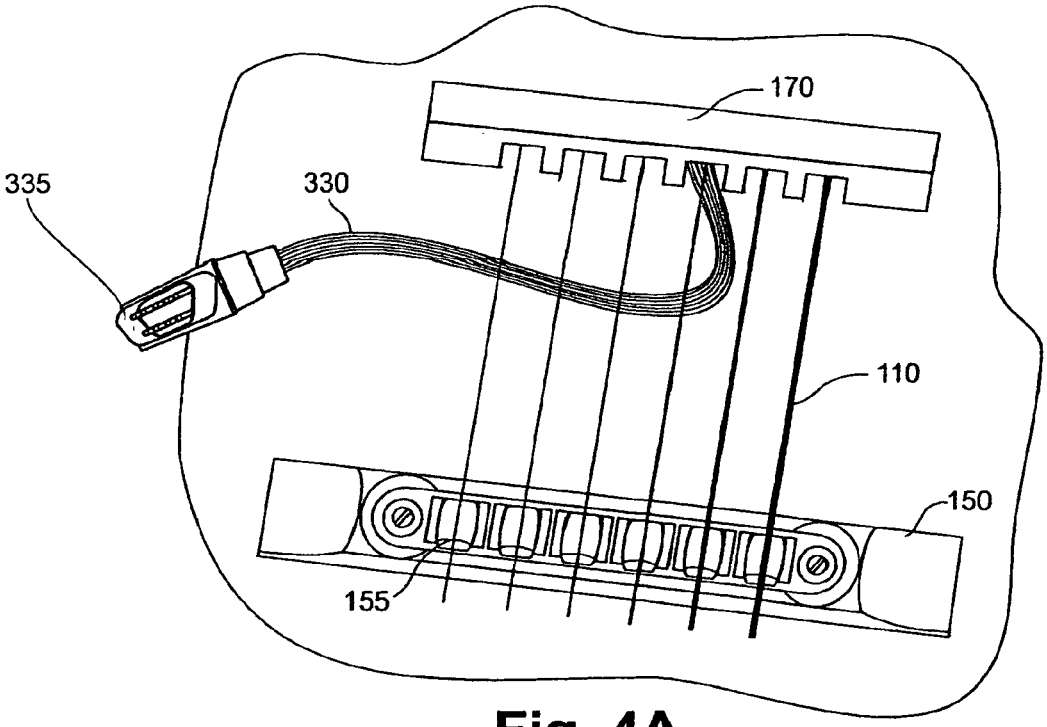
FIG. 4A is a front view and more detailed view of the connector cord that is positioned below the guitar strings and is for use in connecting to the plug.

FIG. 2 shows the details of the bottom the base plate 130. The bottom of the base pate comprises a thin metal plate 205, which is of the same general shape as that of the base plate 130. Attached to the base plate are the volume knob 140, the power switch 135, and an output jack 210, the bottom details of which are shown in the drawings. An electronic circuit board 200 with a ground place containing the electronic circuitry that further comprises a battery 220 and the electronic circuitry as described in FIGS. 6A and 6B. A shield cable 197 for the strings 110 is wired to a connector jack 210*a* that mates to a connector plug 335 from the string cable, as shown in FIG. 4A. The base plate 130 is removable from guitar body 115. If a performer wishes to remove the base plate 130, he or she can unplug the connector jack 210*a* and remove the base plate 130. Because there is a metal plate 205 located on the bottom of the plate 130, the high-powered magnets 190 remain secure and stationary on the magnet tray 180, which sits directly on top of the plate 130. The metal plate 205 also acts as a ground plate for the electronic circuitry further reducing noise.

Figure 3:
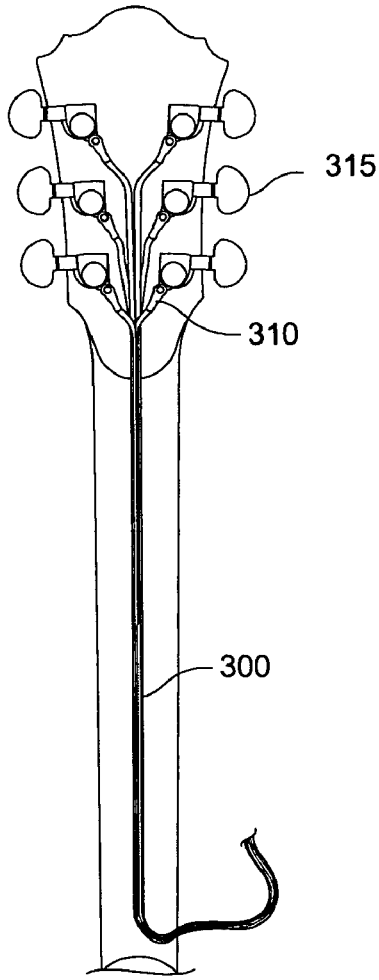
FIG. 3 is rear view of the neck and tuning knobs of the guitar showing the wiring contacts connected directly to the strings on the tuning knobs.

As shown in FIG. 3, a shielded cable 300, which contains six conductors 310 must be electrically coupled to the six strings 110 at the metal tuning knobs 315 on the guitar peg head 120. The cable 300 must be long enough so as to extend across the entire length of the guitar 100. Most all guitars have a backplate or headplate that is glued to the peg head 120. Prior to gluing the backplate or headplate, the electrical connection to the tuning knobs 315 will have been made, and then securely covered by the backplate or headplate. Most all of today's guitars have a slot milled into the neck into which a steel torsion bar is place before the nut 106 and fret board 105 is glued together, as shown in FIG. 1. The shielded cable 300 can be run down this slot to the body of the guitar 100 where it will terminate at connector plug 335. The strings 110 at the bridge 150 must be electrically isolated from each other in a fashion as shown at point 155 in FIG. 4A.

Figure 4B:
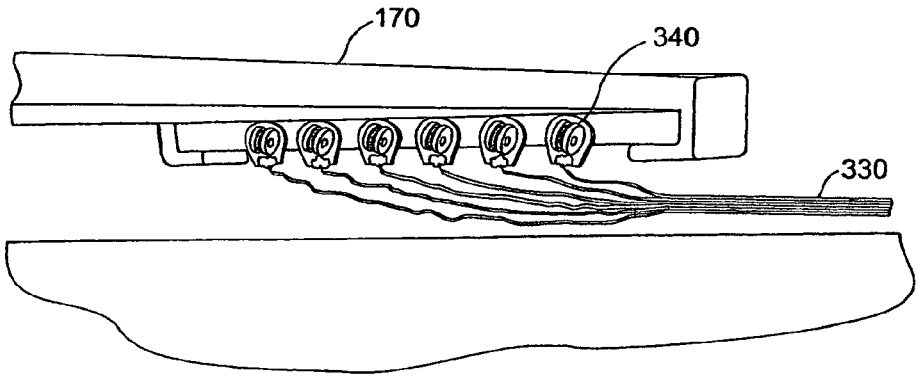
FIG. 4B is detailed view of the wiring used to connect to the strings by way of a plug in 4A.

FIG. 4A shows the strings 110 electrically isolated at the bridge 150 and continuing on through to the securing mechanism 170 at the bottom of the guitar 100. FIG. 4B shows the strings 110 terminating at an individual securing hook 340 for each string. A second set of conducting wires 330 are coupled to the securing hooks 340 which are in turn connected to the strings 110. The wires 330 are shielded and terminate at the connector plug 335.

Figure 5A:
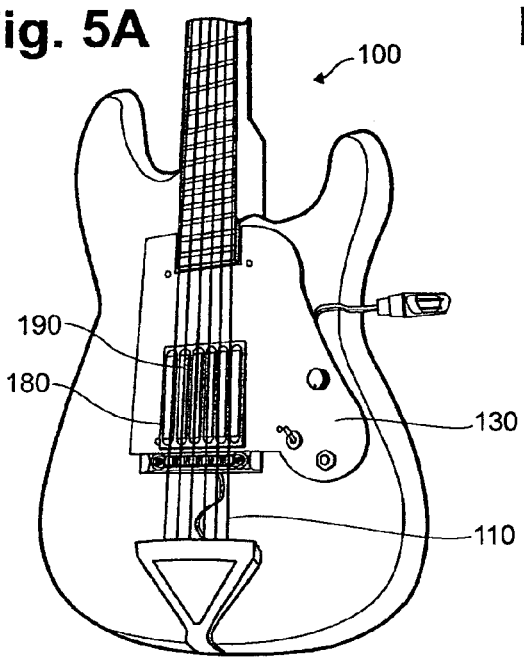
FIG. 5A is a perspective view of the front face of the guitar showing the bipolar magnets arranged at the lower portion of the base plate in a vertical configuration.
Figure 5C:
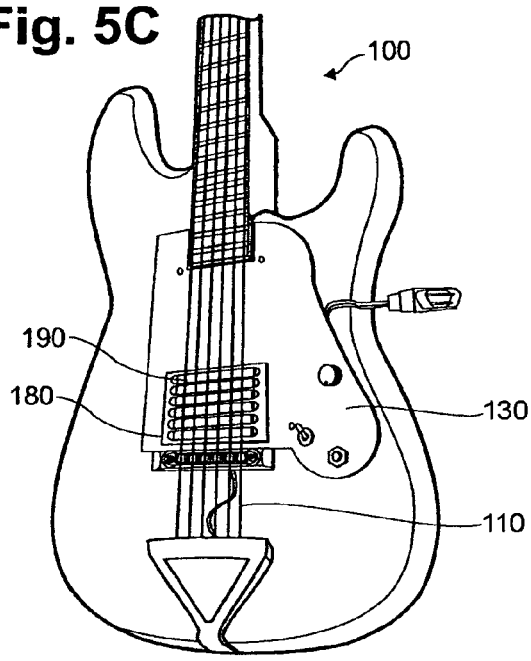
FIG. 5C is a perspective view of the front face of the guitar showing the bipolar magnets arranged at the middle portion of the base plate in a diagonal configuration.
Figure 5B:
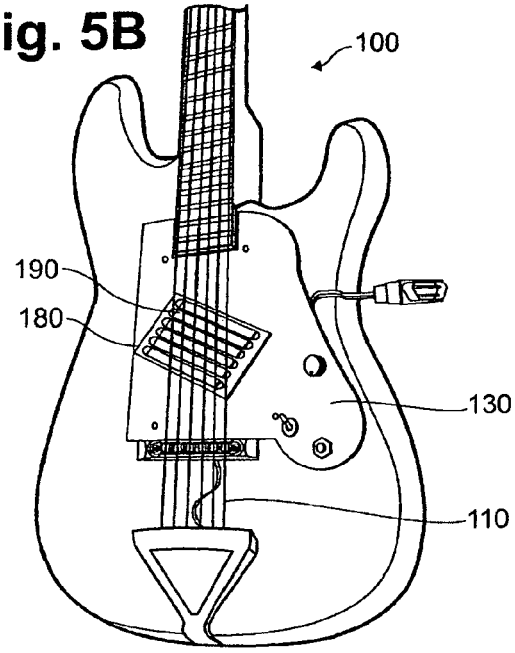
FIG. 5B is a perspective view of the front face of the guitar showing the bipolar magnets arranged at the lower portion of the base plate in a horizontal configuration.
Figure 5D:
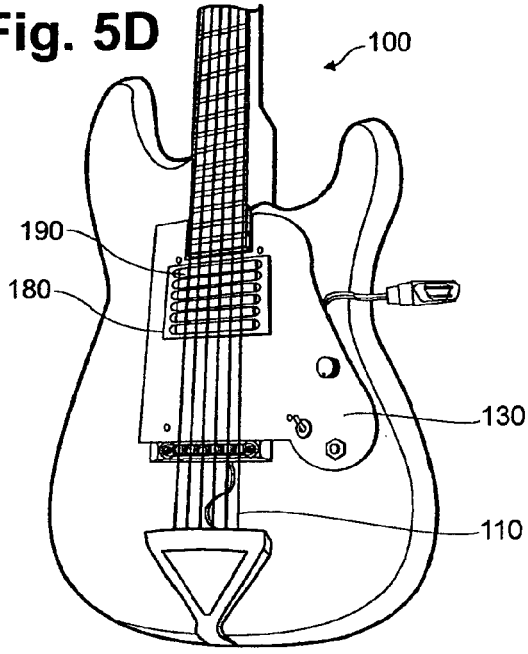
FIG. 5D is a perspective view of the front face of the guitar showing the bipolar magnets arranged at the upper portion of the base plate in a horizontal configuration.

FIGS. 5A through 5D show perspective views of the guitar 100 with the magnets 190 secured on top of a magnet plate 180 in various positions. FIG. 5A shows the magnets 190 at the lower portion of the plate 130 with the magnets 190 in the vertical position. In FIG. 5C, the magnets 190 are at the lower portion of the plate 130 with the magnets 190 in the horizontal position. In FIG. 5B, the magnets 190 are at the middle portion of the plate 130 with the magnets 190 in the diagonal position, and finally, in FIG. 5D, the magnets 190 are in the top portion of the plate 130 with the magnets 190 in the horizontal position. It is understood that any shape or sized magnet can be positioned anywhere on the plate 130 as long as they are within a mutual induction range with the metal strings 110. It is preferred that the magnets 190 be made of Neodymium (NdFeB) at least grade ND40 magnets. These magnets are made from a powder which is compressed into many shapes, i.e. donut, cylinder, bar, sphere, triangle, etc. These different shapes when placed on the plate 130 allow for many unusual tones when the guitar strings 110 are plucked. If the magnets are moved rapidly back and forth, a tremolo effect is produced. When the strings 110 are plucked and there is current running through the metal vibrating strings 110, induced by the magnets 190. That signal in the strings 110 is then fed into the circuitry as described in FIGS. 6A and 6B.

Figure 6A:
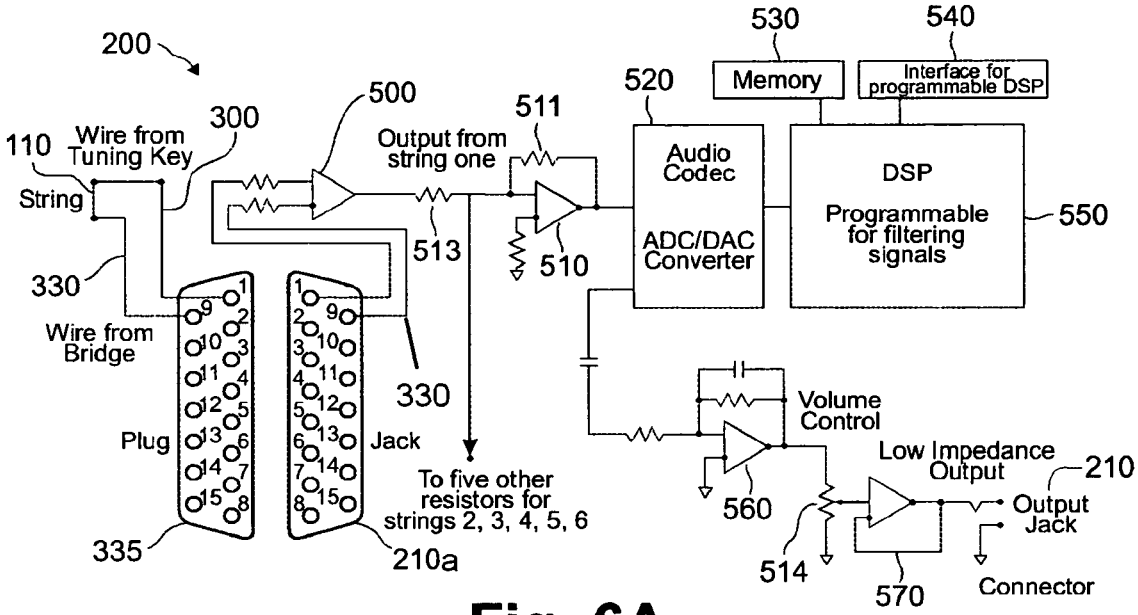
FIG. 6A is a detailed view of the differential amplifier circuitry.
Figure 6B:
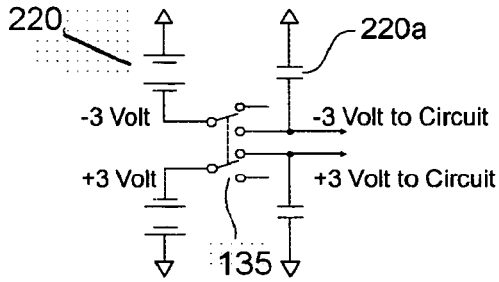
FIG. 6B is a detailed view of the circuitry forming the batteries and switch used to power the guitar circuitry.

As shown in FIGS. 6A and 6B, each of the strings 110 of the guitar 100 are connected to a plug 335 via a shielded cable 300 and 330. The plug 335 mates to a jack 210*a* that is connected to the difference amplifier 500. The amplifier 500 has the desired characteristics of a high common mode rejection, low power, low noise, and good gain in an economical integrated circuit. Preferably, there should be one difference amplifier for each string 110. Their differential amplifier outputs are electrically summed into a low noise amplifier 510. The resistor 513 is matched to create even volume for each string 110. This is necessary since the lower strings 110 vibrate at a lower frequency. Consequently, their signal is less so the resistors 513 get smaller in resistance for the lower strings 110. In the preferred embodiment, the average value for resistor 513 is 100 ohms. Resistor 511 of summing amplifier 510 is selected to provide more gain to the signals in the strings 110. A typical value for resistor 511 is 10K ohms.

The audio codec 520 is connected to the output of the summing amplifier 510. The codec 520 functions to anti-alias the string signal, over sample the string signal and convert it from an analog to a digital signal. The codec 520 then sends the digital signal to a digital signal processor 550. In the preferred embodiment, the codec 520 has at least a signal to noise ratio of 83 db, which is considered very low noise. Its sampling rate is at least 44.1 KHz, which is well faster than any frequency obtained from a vibrating string. The codec 520 will have at least a 16-bit analog to digital conversion of each analog signal sample. The codec 520 will have at least two times over-sampling of the analog signal.

The digital signal processor 550 is typically programed to be able to modify selected frequencies by use of an interface 540. By doing so, many usual and pleasing frequency modifications can be achieved by the digital signal processor 550. The codec will pass the string frequencies between 20 Hz and 20 kHz, which adequately encompasses guitar frequencies. With the signal to noise ratio at about 80 db, the digital signal processor 550 will be programmed to enhance those frequencies, when amplified, are deemed enjoyable to listen to. Once the digital signal processor 550 has been programmed, its program is stored in permanent memory 530. The digital signal processor 550 receives the digital signal from the codec 520. When the signal is received, the digital signal processor 550 processes the digital signal and returns it to the codec 520. The codec then converts the digital signal back into an analog signal and sends it to the volume control amplifier 560. The volume control amplifier 560 then feeds its signal to a variable resistor 514, which serves as the volume control knob 140. The volume control amplifier 560 is connected as a unity gain-follower amplifier 570, which provides a very low impedance output to the output jack 210 on the base plate 130. The low impedance output serves to minimize the noise in the guitar cord that carries the audio signal from the output jack 210 to the typical guitar power amplifier. An on-off power switch 135 with battery 220 and battery filter capacitors 220*a* provides power to the circuit board as shown in FIG. 6B. Battery voltages will typically be between 1.5 and 5 volts.

While the inventive apparatus, as well as a method of cooling ambient air as described and claimed herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

Although the invention has been described in detail with reference to one or more particular preferred embodiments, persons possessing ordinary skill in the art to which this invention pertains will appreciate that various modifications and enhancements may be made without departing from the spirit and scope of the claims that follow.

What is claimed is:

1. A low noise vibrating string transducer comprising:

a base plate coupled to a metal plate, wherein said base plate is further coupled to a stringed instrument, said base plate having a volume control knob and a securing clamp for securing strings of said stringed instrument;

a bipolar magnet for varying tones of the stringed instrument;

a conducting string further comprising a first end and a second end;

said conducting string is connected to a tuning knob at said first end and wherein said conducting string is connected to said securing clamp at the second end such that said conducting string is made sufficiently taut by rotating said tuning knob said conducting string rests above said base plate on a bridge wherein said bridge is coupled to said base plate such that said bridge electrically isolates said conducting string from a second conducting string;

an amplifier circuit;

Said amplifier circuit is coupled to a power source;

Said volume control knob is electrically coupled to said amplifier circuit;

Said second end of said conducting string is electrically coupled to said amplifier circuit;

said bipolar magnet is coupled to said metal plate such that at least a portion of said bipolar magnet is directly below said conducting string, wherein said metal plate is a ground plane for a portion of electronic circuitry, further reducing noise by properly grounding the portion of the electronic circuitry.

2. The low noise vibrating string transducer of claim 1 wherein:

said amplifier circuit further comprising:

a difference amplifier;

said difference amplifier having a first and a second input and an output a summing amplifier;

said summing amplifier having a first and a second input and an output;

an analog converter having an input and an at least one output;

said output of said summing amplifier is coupled to said input of said analog to digital converter;

said at least one output of said analog to digital converter is coupled to said first input of said difference amplifier;

a digital signal processor;

said digital signal processor further comprising:

a memory circuit;

an interface for programming said digital signal processor;

said digital signal processor is coupled to said analog to digital converter;

a variable resistor;

said output of said difference amplifier is coupled to said variable resistor;

said variable resistor is coupled to a low impedance amplifier; said low impedance amplifier further comprising an output jack.

3. The low noise vibrating string transducer of claim 2, wherein said difference amplifier further comprises at least two inputs and an output, said at least two inputs coupled to each respective end of said conductive string;

the output of said difference amplifier is coupled to the first input of said summing amplifier.

4. The low noise vibrating string transducer of claim 1, wherein:

said stringed instrument further comprises:

a peg head;

a fret board having a first and a second end such that said peg head is coupled to the first end of said fret board and that said second of said fret board is coupled to said base plate;

said tuning knob of said stringed instrument is fixed to said peg head.

5. The low noise vibrating string transducer of claim 1, wherein said bipolar magnet is comprised of neodymium (NdFeB) compound.

6. The low noise vibrating string transducer of claim 1 further comprising:

a first conducting wire;

a second conducting wire;

said first conducting wire is electrically coupled at a first end to said tuning knob and is coupled to the first input of said difference amplifier at a second end;

said second conducting wire further comprises a first and a second end and said first end is electrically coupled to said second end of said conducting string such that the second end of said second conducting wire is electrically coupled to said second input of said difference amplifier.

7. The low noise vibrating string transducer of claim 6 wherein said first and second conducting wires are surrounded by a shielded cable.

8. A method of making a low noise vibrating string transducer comprising the steps of:

providing a stringed instrument;

coupling a conducting string to a tuning knob of said stringed instrument at a first end of said conducting string and coupling a conducting string to a securing clamp of said instrument at a second end of said conducting string such that said conducting string is in direct contact with a bridge wherein said bridge electrically isolates said conducting wire and is coupled to a base plate of said stringed instrument, wherein said base plate is in a shape which allows it to fit underneath strings of said stringed instrument;

fixing said securing clamp to said base plate;

assembling said base plate from a non-conducting base plate that is substantially in the shape of said base plate;

assembling a metal plate that is substantially in the same shape as said non-conducting base plate and securing said metal plate to said non conducting base plate;

securing a bipolar magnet to said non-conducting plate such that a portion of said bipolar magnet is located directly beneath said conducting string; and grounding a portion of electronic circuitry by use of said metal plate.

9. The method of claim 8 further comprising the steps of:

coupling said tuning knob to a peg head of said stringed instrument;

coupling a fret board of said stringed instrument to said peg head at a first end of said fret board;

coupling said fret board to said base plate at a second end of said fret board.

10. The method of claim 8 further comprising the steps of:

programming a digital signal processor to pass electrical signals of frequencies between 20 Hz and 20 KHz;

coupling said digital signal processor to an analog to digital converter;

coupling a summing amplifier to said analog to digital converter;

coupling said analog to digital converter to a volume control amplifier;

coupling said volume control amplifier to a variable resistor wherein said variable resistor is coupled to a low impedance amplifier wherein said low impedance amplifier further comprises an output jack.

11. The method of claim 10 further comprising the steps of:

coupling a conducting wire to said tuning knob at a first end of said conducting wire;

coupling said conducting wire to said first difference amplifier;

surrounding said conducting wire with a shielding cable.

* * * * *